US007637583B2

(12) United States Patent
Sayama

(10) Patent No.: US 7,637,583 B2
(45) Date of Patent: Dec. 29, 2009

(54) METHOD FOR PRODUCING LIQUID-JET HEAD AND METHOD FOR DRIVING LIQUID-JET HEAD

(75) Inventor: Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 159 days.

(21) Appl. No.: 11/934,360

(22) Filed: Nov. 2, 2007

(65) Prior Publication Data

US 2008/0106557 A1 May 8, 2008

(30) Foreign Application Priority Data

Nov. 6, 2006 (JP) ..... 2006-300744

(51) Int. Cl.
*B41J 29/38* (2006.01)
*B41J 2/205* (2006.01)
*B41J 29/393* (2006.01)

(52) U.S. Cl. ..... 347/11; 347/15; 347/19

(58) Field of Classification Search ..... 347/11, 347/15

See application file for complete search history.

(56) References Cited

U.S. PATENT DOCUMENTS

2001/0022595 A1* 9/2001 Takahashi et al. ..... 347/15
2001/0028370 A1* 10/2001 Takahashi ..... 347/10
2002/0036669 A1* 3/2002 Hosono et al. ..... 347/19
2003/0234826 A1* 12/2003 Hosono et al. ..... 347/10
2008/0266340 A1* 10/2008 Williams et al. ..... 347/12

FOREIGN PATENT DOCUMENTS

JP 10-81012 A 3/1998
JP 10-250061 A 9/1998

* cited by examiner

*Primary Examiner*—Matthew Luu
*Assistant Examiner*—Shelby Fidler
(74) *Attorney, Agent, or Firm*—Sughrue Mion, PLLC

(57) ABSTRACT

A liquid-jet head selectively forms a large dot or a small dot. The large dot is ejected when a plurality of pulse signals are selected, and the small dot upon selection of a smaller number of the pulse signals. There is a contraction of the pressure generating chamber to eject a droplet through the nozzle, and a vibration damping step. The drive waveforms are set to implement this approach, and have particular characteristics.

6 Claims, 8 Drawing Sheets

METHOD FOR PRODUCING LIQUID-JET HEAD AND METHOD FOR DRIVING LIQUID-JET HEAD

The entire disclosure of Japanese Patent Application No. 2006-300744 filed Nov. 6, 2006 is expressly incorporated by reference herein.

BACKGROUND

1. Technical Field

The present invention relates to a method for producing, and a method for driving, a liquid-jet head in which a part of a pressure generating chamber communicating with a nozzle orifice for jetting a liquid is constructed of a vibration plate, a piezoelectric element is formed on the surface of the vibration plate, and the liquid is jetted by the displacement of the piezoelectric element.

2. Related Art

Among liquid-jet apparatuses is, for example, an ink-jet recording apparatus having an ink-jet recording head comprising a plurality of pressure generating chambers for generating a pressure for ink droplet ejection by a piezoelectric element or a heat generating element, a common reservoir for supplying ink to each pressure generating chamber, and a nozzle orifice communicating with each pressure generating chamber. With this ink-jet recording apparatus, ejection energy is applied to ink in the pressure generating chamber communicating with the nozzle orifice corresponding to a print signal to eject an ink droplet through the nozzle orifice.

The ink-jet recording head, in which a part of the pressure generating chamber communicating with the nozzle orifice for ejecting an ink droplet is constructed of a vibration plate, and the vibration plate is deformed by the piezoelectric element to pressurize ink in the pressure generating chamber, thereby ejecting an ink droplet through the nozzle orifice, is put to practical use in two types: one of the types using a piezoelectric actuator in a longitudinal vibration mode expanding and contracting in the axial direction of the piezoelectric element, and the other type using a piezoelectric actuator in a flexural vibration mode.

A drive waveform comprising a rectangular wave has been used as a drive signal for driving the piezoelectric element of such an ink-jet recording head. This drive waveform comprising the rectangular wave has a step of discharging from an intermediate drive voltage in a wait state to expand the pressure chamber, thereby sucking ink into the pressure chamber; a step of maintaining a minimum drive voltage; a step of charging to contract the pressure generating chamber, thereby ejecting ink; a step of maintaining a charge final voltage; and a step of discharging to return to the intermediate drive voltage, and an ink droplet is discharged by this drive waveform (see, for example, JP-A-1998-250061).

A proposal has been made for a technology which makes it possible to carry out gradation recording by ejecting ink droplets of different weights through the same nozzle (see, for example, JP-A-1998-081012). With such a technology, a plurality of the same pulse signals are generated within one recording cycle to produce a plurality of fine ink droplets, and these plural fine ink droplets are integrated, before their landing on a recording paper, to produce a large ink droplet.

The pulse signals generated in plural numbers within one recording cycle are defined in conformity with the design of an ink-jet head. Generally, they have a waveform having a vibration damping step of damping the vibration of ink after the step of ejecting ink. A plurality of continuous pulse signals can produce an ink droplet of a predetermined size, on the one hand, while one pulse signal can produce, for example, a fine ink droplet, on the other hand.

According to the above-described techniques, however, if variations in the capacity of supplying ink occur owing to the manufacturing error of the ink-jet recording head, particularly, the manufacturing error of an ink supply port for supplying ink to the reservoir, predetermined sizes may fail to be maintained for large and small ink droplets.

SUMMARY

An advantage of some aspects of the invention is to provide a method for producing, and a method for driving, a liquid-jet head which can eject desired large and small liquid droplets, regardless of the individual error of the liquid-jet head.

According to an aspect of the invention, there is provided a method for producing a liquid-jet head, including a pressure generating element for ejecting a liquid within a pressure generating chamber through a nozzle orifice, which liquid-jet head selectively forms a large dot ejected upon selection of a plurality of pulse signals selected from plural pulse signals generated within one recording cycle and a small dot ejected upon selection of a smaller number of the pulse signals than the number of the plurality of the pulse signals for the large dot, the pulse signal having an ejection step of contracting the pressure generating chamber to eject a liquid droplet through the nozzle orifice, and a vibration damping step of expanding the pressure generating chamber with a predetermined timing after the ejection step to damp vibration of the liquid within the pressure generating chamber after ejection, the method comprising: a measurement step of setting a first drive waveform, as the pulse signal, and a first drive voltage such that the large dot of a desired size can be formed, and measuring a size of the small dot with use of the first drive waveform and first drive voltage; and a correction step of setting a second drive waveform whose waveform corresponding to the vibration damping step has been adjusted in a direction in which the large dot becomes small, and also setting a second drive voltage which is higher than the first drive voltage, when the measured size of the small dot is smaller than a predetermined size, and setting a second drive waveform whose waveform corresponding to the vibration damping step has been adjusted in a direction in which the large dot becomes large, and also setting a second drive voltage which is lower than the first drive voltage, when the measured size of the small dot is larger than the predetermined size.

According to this aspect, after the large dot is conformed to the design, the size of the small dot is measured. Depending on the size of the small dot, settings are made such that when the small dot is smaller than the predetermined range, the pulse signal is changed to render the large dot small, and the drive voltage is stepped up, and that when the small dot is larger than the predetermined range, the pulse signal is changed to render the large dot large, and the drive voltage is stepped down. By so doing, a liquid-jet head providing the large dot and the small dot in predetermined ranges can be constructed.

It is preferable that adjustment of a vibration damping property of the waveform corresponding to the vibration damping step is adjustment of an amplitude of the waveform corresponding to the vibration damping step.

According to this embodiment, in selecting the pulse signal for adjusting the size of the large dot, the pulse signal whose waveform corresponding to the vibration damping step has been adjusted in amplitude is used, whereby adjustment of the size can be made with ease.

It is also preferable that the second drive waveform whose waveform corresponding to the vibration damping step has been adjusted in the direction in which the large dot becomes small has been increased in the amplitude of the waveform corresponding to the vibration damping step when a waveform interval of the second drive waveform is an integer n times a natural vibration cycle Tc of the liquid within the pressure generating chamber, the second drive waveform whose waveform corresponding to the vibration damping step has been adjusted in the direction in which the large dot becomes small has been decreased in the amplitude of the waveform corresponding to the vibration damping step when the waveform interval of the second drive waveform is (the integer n+½) times the natural vibration cycle Tc of the liquid within the pressure generating chamber, the second drive waveform whose waveform corresponding to the vibration damping step has been adjusted in the direction in which the large dot becomes large has been decreased in the amplitude of the waveform corresponding to the vibration damping step when the waveform interval of the second drive waveform is the integer n times the natural vibration cycle Tc of the liquid within the pressure generating chamber, and the second drive waveform whose waveform corresponding to the vibration damping step has been adjusted in the direction in which the large dot becomes large has been increased in the amplitude of the waveform corresponding to the vibration damping step when the waveform interval of the second drive waveform is (the integer n+½) times the natural vibration cycle Tc of the liquid within the pressure generating chamber.

According to this embodiment, when the waveform interval of the drive waveform is the integer n times the natural vibration cycle Tc of the liquid within the pressure generating chamber, the amplitude of the waveform corresponding to the vibration damping step is increased to enhance the vibration damping property. When the waveform interval of the drive waveform is (the integer n+½) times the natural vibration cycle Tc of the liquid within the pressure generating chamber, the amplitude of the waveform corresponding to the vibration damping step is decreased to enhance the vibration damping property. By this procedure, the large dot is controlled in a direction in which it becomes small. When adjustment is made in the reverse direction, the large dot is controlled in a direction in which it becomes large.

It is also preferable that an interval between the ejection step and the vibration damping step is a half of a natural vibration cycle Tc of the liquid within the pressure generating chamber.

According to this embodiment, the interval between the ejection step and the vibration damping step is a half of the natural vibration cycle Tc of the liquid within the pressure generating chamber. Consequently, the vibration damping step acts effectively to damp vibration.

It is also preferable that the second drive waveform and the second drive voltage are selected from drive waveforms and drive voltages which have been prepared beforehand.

According to this embodiment, the second drive waveform and the second drive voltage can be selected from among those prepared beforehand. Thus, they can be set relatively easily.

According to another aspect of the invention, there is provided a method for driving a liquid-jet head including a pressure generating element for ejecting a liquid within a pressure generating chamber through a nozzle orifice, the method being adapted to selectively form a large dot ejected upon selection of a plurality of pulse signals selected from plural pulse signals generated within one recording cycle, and a small dot ejected upon selection of a smaller number of the pulse signals than the number of the plurality of the pulse signals for the large dot, the pulse signal having an ejection step of contracting the pressure generating chamber to eject a liquid droplet through the nozzle orifice, and a vibration damping step of expanding the pressure generating chamber with a predetermined timing after the ejection step to damp vibration of the liquid within the pressure generating chamber after ejection, the method comprising: setting a first drive waveform, as the pulse signal, and a first drive voltage such that the large dot of a desired size can be formed; measuring a size of the small dot with use of the first drive waveform and the first drive voltage; setting a second drive waveform whose waveform corresponding to the vibration damping step has been adjusted in a direction in which the large dot becomes small, and also using a second drive voltage which is higher than the first drive voltage, when the measured size of the small dot is smaller than a predetermined size; and setting a second drive waveform whose waveform corresponding to the vibration damping step has been adjusted in a direction in which the large dot becomes large, and also using a second drive voltage which is lower than the first drive voltage, when the measured size of the small dot is larger than the predetermined size, thereby driving the liquid-jet head with use of the second drive waveform and the second drive voltage.

According to this aspect, after the large dot is conformed to the design, the size of the small dot is measured. Depending on the size of the small dot, settings are made such that when the small dot is smaller than the predetermined range, the pulse signal is changed to render the large dot small, and the drive voltage is stepped up, and that when the small dot is larger than the predetermined range, the pulse signal is changed to render the large dot large, and the drive voltage is stepped down. By so doing, liquid jetting providing the large dot and the small dot in predetermined ranges can be performed.

According to the invention, the drive signal and the drive voltage can be set relatively easily so that desired large and small liquid droplets can be ejected, regardless of the individual error of the liquid-jet head. By driving the liquid-jet head using the drive signal and the drive voltage, highly reliable printing can be carried out.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail based on its embodiments.

Embodiment 1

Figure 1:
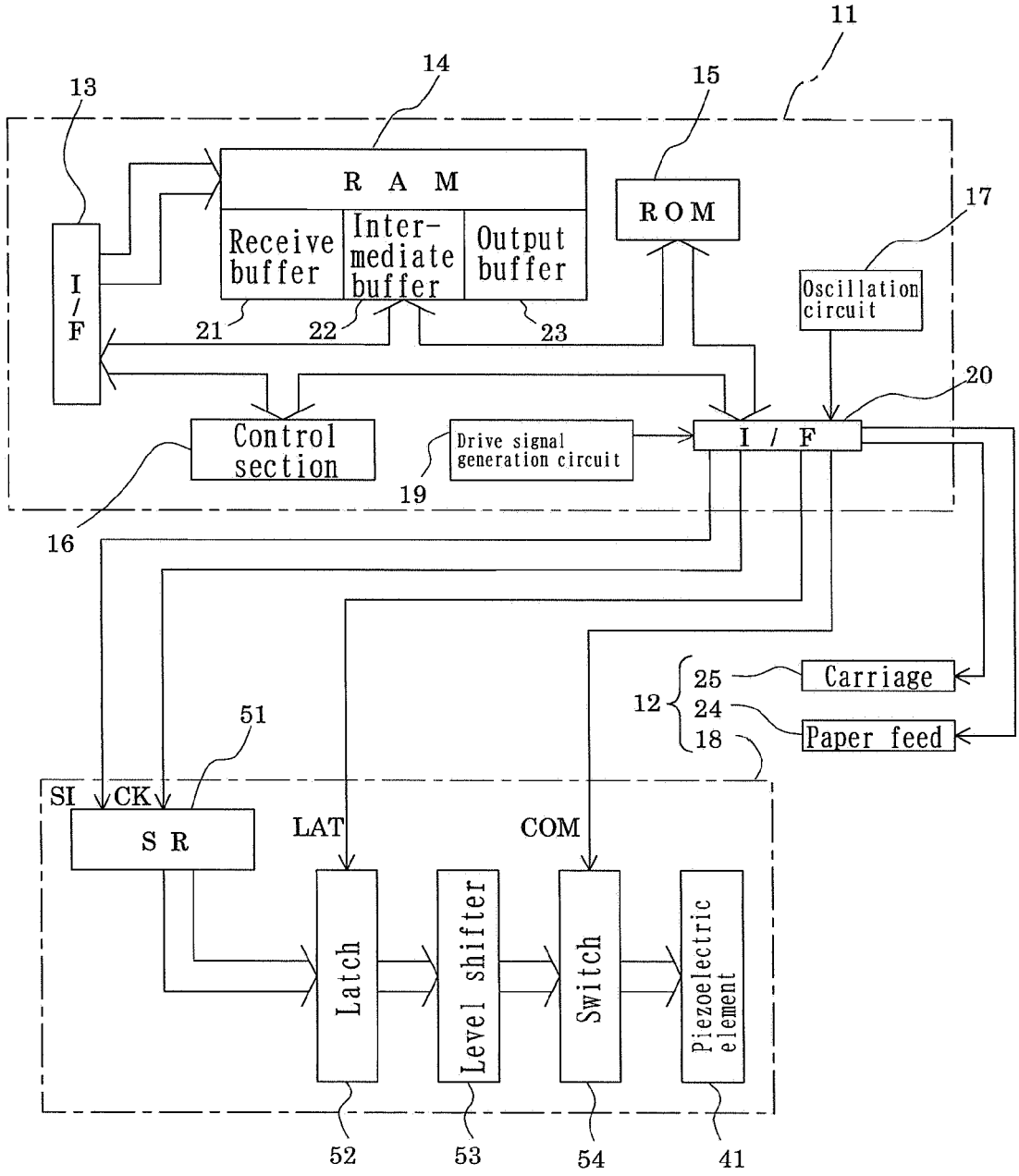
FIG. 1 is a view showing the schematic constitution of an ink-jet recording apparatus according to an embodiment of the invention.

FIG. 1 is a view showing the schematic constitution of an ink-jet recording apparatus as an example of a liquid-jet apparatus to which Embodiment 1 of the invention is applied. As shown in FIG. 1, the ink-jet recording apparatus of the present embodiment is schematically composed of a printer controller 11 and a print engine 12.

The printer controller 11 comprises an external interface 13 (hereinafter referred to as external I/F 13), an RAM 14 for temporarily storing various data, an ROM 15 storing control programs, etc., a control section 16 configured to include a CPU, etc., an oscillation circuit 17 for generating a clock signal, a drive signal generation circuit 19 for generating a drive signal for supply to an ink-jet recording head 18, and an internal interface 20 (hereinafter referred to as internal I/F 20) for transmitting dot pattern data (bit map data), etc., expanded based on the drive signal or printing data, to the print engine 12.

The external I/F 13 receives the printing data, which are composed of, for example, character codes, graphic functions, and image data, from a host computer, etc. (not shown). Through the external I/F 13, a busy signal (BUSY) and an acknowledge signal (ACK) are outputted to the host computer, etc.

The RAM 14 functions as a receive buffer 21, an intermediate buffer 22, an output buffer 23, and a work memory (not shown). The receive buffer 21 temporarily stores the printing data received by the external I/F 13, the intermediate buffer 22 stores intermediate code data converted by the control section 16, and the output buffer 23 stores the dot pattern data. These dot pattern data are composed of print data which are obtained by decoding (translating) gradation data.

The ROM 15 stores font data, graphic functions, etc. as well as the control programs (control routines) for performing various data processings.

The control section 16 reads the printing data stored in the receive buffer 21, and stores the intermediate code data, which have been obtained by converting the printing data, into the intermediate buffer 22. The control section 16 also analyzes the intermediate code data read from the intermediate buffer 22, and expands the intermediate code data to the dot pattern data by reference to the font data, graphic functions, etc. stored in the ROM 15. After applying necessary decorative treatment, the control section 16 stores the expanded dot pattern data into the output buffer 23.

After the dot pattern data corresponding to one line to be produced by the ink-jet recording head 18 are obtained, the one line-equivalent dot pattern data are outputted to the ink-jet recording head 18 through the internal I/F 20. Upon outputting of the one-line dot pattern data from the output buffer 23, the intermediate code data after expansion are erased from the intermediate buffer 22, and expansion treatment of next intermediate code data is carried out.

The print engine 12 is configured to include the ink-jet recording head 18, a paper feed mechanism 24, and a carriage mechanism 25. The paper feed mechanism 24 is composed of a paper feed motor, a paper feed roller, etc., and sequentially feeds printing and storing media, such as recording sheets, in a manner interlocked to the recording action of the ink-jet recording head 18. That is, the paper feed mechanism 24 moves the printing and storing medium relatively in a subscanning direction. The carriage mechanism 25 is composed of a carriage capable of bearing the ink-jet recording head 18, and a carriage drive portion for running the carriage in a main scanning direction. By running the carriage, the ink-jet recording head 18 is moved in the main scanning direction. The carriage drive portion can adopt an arbitrary configuration, as long as it is a mechanism capable of running the carriage, such as one using a timing belt. The ink-jet recording head 18 has many nozzle orifices along the subscanning direction, and ejects ink droplets through each nozzle orifice with a timing defined by the dot pattern data, etc.

Figure 2:
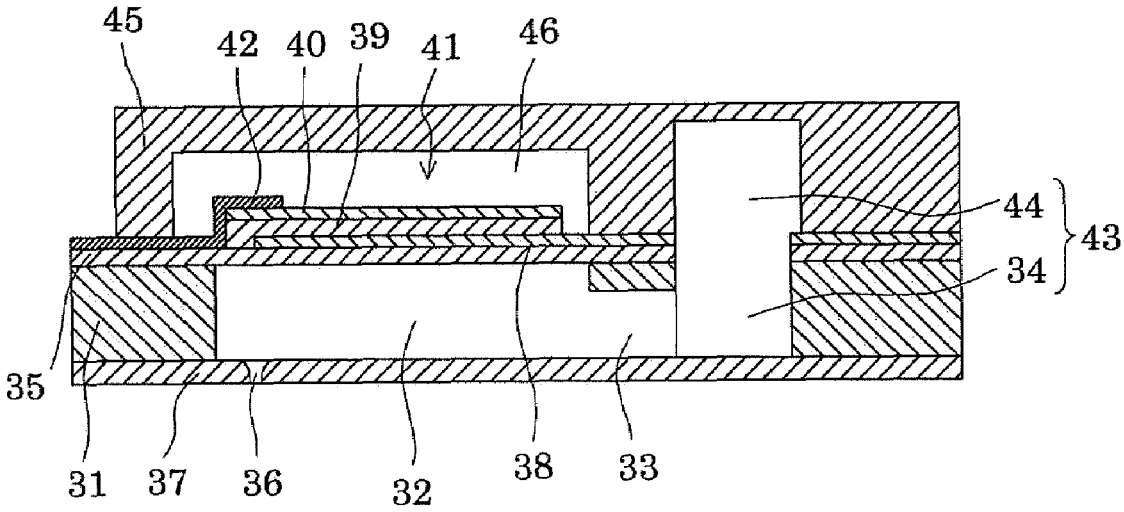
FIG. 2 is a sectional view of an ink-jet recording head according to the embodiment of the invention.
Figure 3:
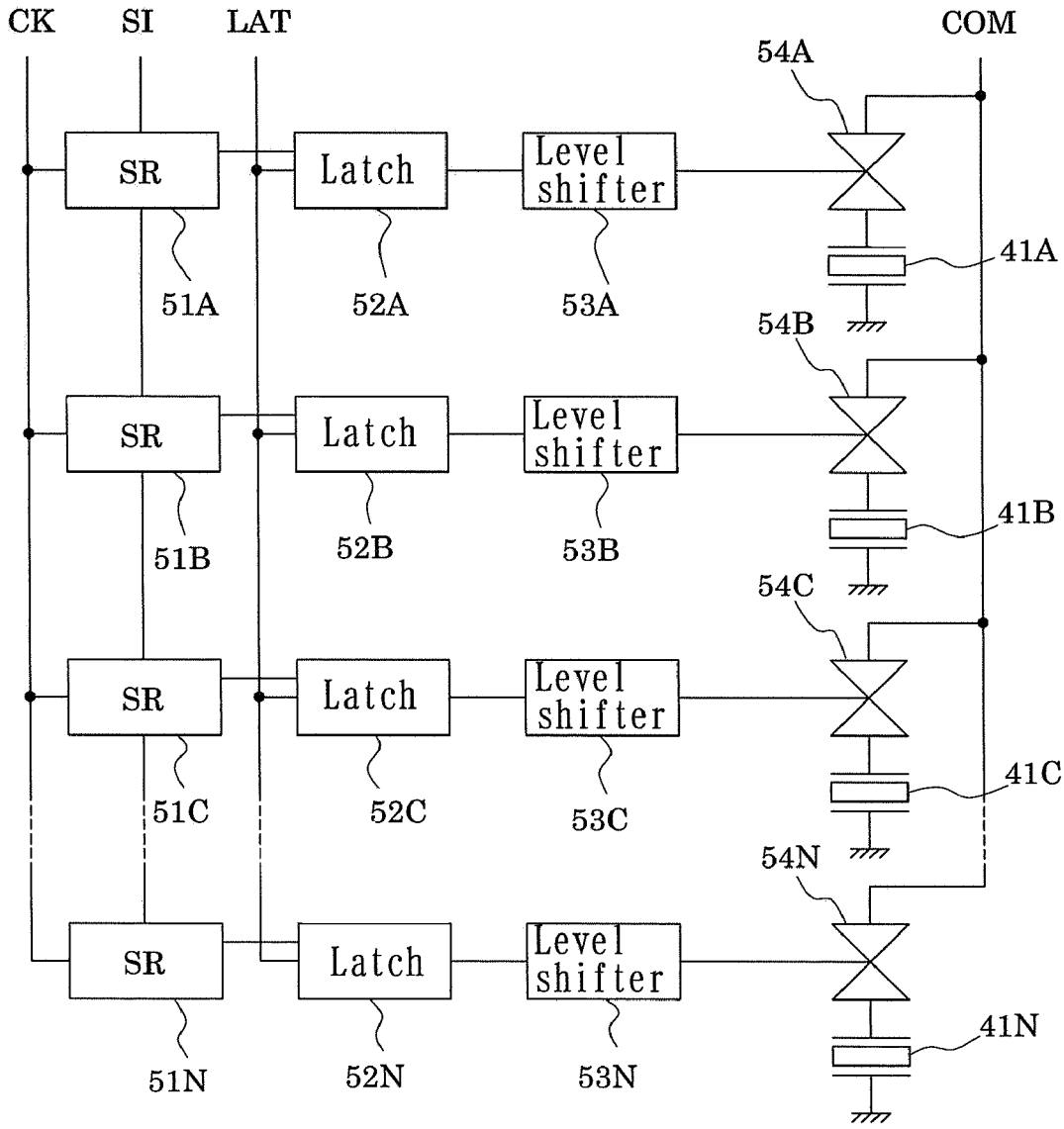
FIG. 3 is an electrical block diagram of the ink-jet recording head according to the embodiment of the invention.

Next, the ink-jet recording head 18 will be described in detail. FIG. 2 is a view showing the mechanical configuration of the ink-jet recording head, and FIG. 3 is a view showing the electrical constitution of the ink-jet recording head.

The ink-jet recording head 18 of the present embodiment is an ink-jet recording head in a so-called flexural vibration mode. As shown in FIG. 2, a pressure generating chamber 32, and a communicating portion 34 communicating with the pressure generating chamber 32 via an ink supply path 33 are formed in a passage-forming substrate 31. One surface of the passage-forming substrate 31 is sealed with a vibration plate 35, and the other surface thereof is sealed with a nozzle plate 37 having a nozzle orifice 36.

On the side of the vibration plate 35 opposite to the pressure generating chamber 32, a piezoelectric element 41 as an example of a pressure generating element is formed, the piezoelectric element 41 being composed of a lower electrode film 38, a piezoelectric layer 39, and an upper electrode film 40, each of which comprises a thin film formed, for example, by film deposition and lithography. A lead electrode 42 extends from the vicinity of one end, in the longitudinal direction, of the piezoelectric element 41 to the top of the vibration plate 35, and external wiring (not shown), such as a flexible cable, is connected to the vicinity of one end of the lead electrode 42.

The lower electrode film 38 constituting the piezoelectric element 41 comprises, for example, platinum (Pt), and is formed in a thickness of the order of 0.2 μm. The upper electrode film 40 comprises, for example, platinum (Pt) or iridium (Ir), and is formed in a thickness of the order of 0.1 μm.

The piezoelectric layer 39 comprises, for example, a piezoelectric ceramic material such as lead zirconate titanate (PZT), and its thickness is preferably 0.5 μm or more, but 3 μm or less. In the present embodiment, for example, its thickness is of the order of 1 μm.

To the side of the passage-forming substrate 31 where the piezoelectric element 41 is located, a reservoir forming plate 45 is joined which has a reservoir portion 44 formed therein, the reservoir portion 44 communicating with the communicating portion 34 to constitute a reservoir 43. An ink tank (not shown) is connected to the reservoir portion 44. In the reservoir forming plate 45, a piezoelectric element holding portion 46 covering the piezoelectric element 41 is provided, and the piezoelectric element 41 is held within the piezoelectric element holding portion 46.

The piezoelectric element 41 of the above-described ink-jet recording head 18 is supplied with electrical signals, for example, the drive signal (COM) or the print data (SI) to be described later, via external wiring (not shown).

With the thus constructed ink-jet recording head 18, when a voltage is applied to the piezoelectric element 41, the piezoelectric element 41 warps, whereupon the vibration plate 35 is displaced to contract the pressure generating chamber 32, thereby ejecting an ink droplet through the nozzle orifice 36.

Next, the electrical configuration of the ink-jet recording head 18 will be described.

As shown in FIG. 1, the ink-jet recording head 18 is equipped with a shift register 51, a latch circuit 52, a level shifter 53, a switch 54, and the piezoelectric element 41. As shown in FIG. 3, moreover, the shift register 51, the latch circuit 52, the level shifter 53, the switch 54, and the piezoelectric element 41 are composed, respectively, of shift register elements 51A to 51N, latch elements 52A to 52N, level shifter elements 53A to 53N, switch elements 54A to 54N, and piezoelectric elements 41A to 41N, provided for the respective nozzle orifices 36 of the ink-jet recording head 18. These elements are electrically connected in the sequence of the shift register 51, the latch circuit 52, the level shifter 53, the switch 54, and the piezoelectric element 41.

The shift register 51, the latch circuit 52, the level shifter 53, and the switch 54 produce a drive pulse from an ejection drive signal generated by the drive signal generation circuit 19. Here, the drive pulse refers to an application pulse applied actually to the piezoelectric element 41.

Next, control over the ink-jet recording head 18 having the above electrical configuration will be described. The procedure for applying the drive pulse to the piezoelectric element 41 will be explained first.

Figure 4:
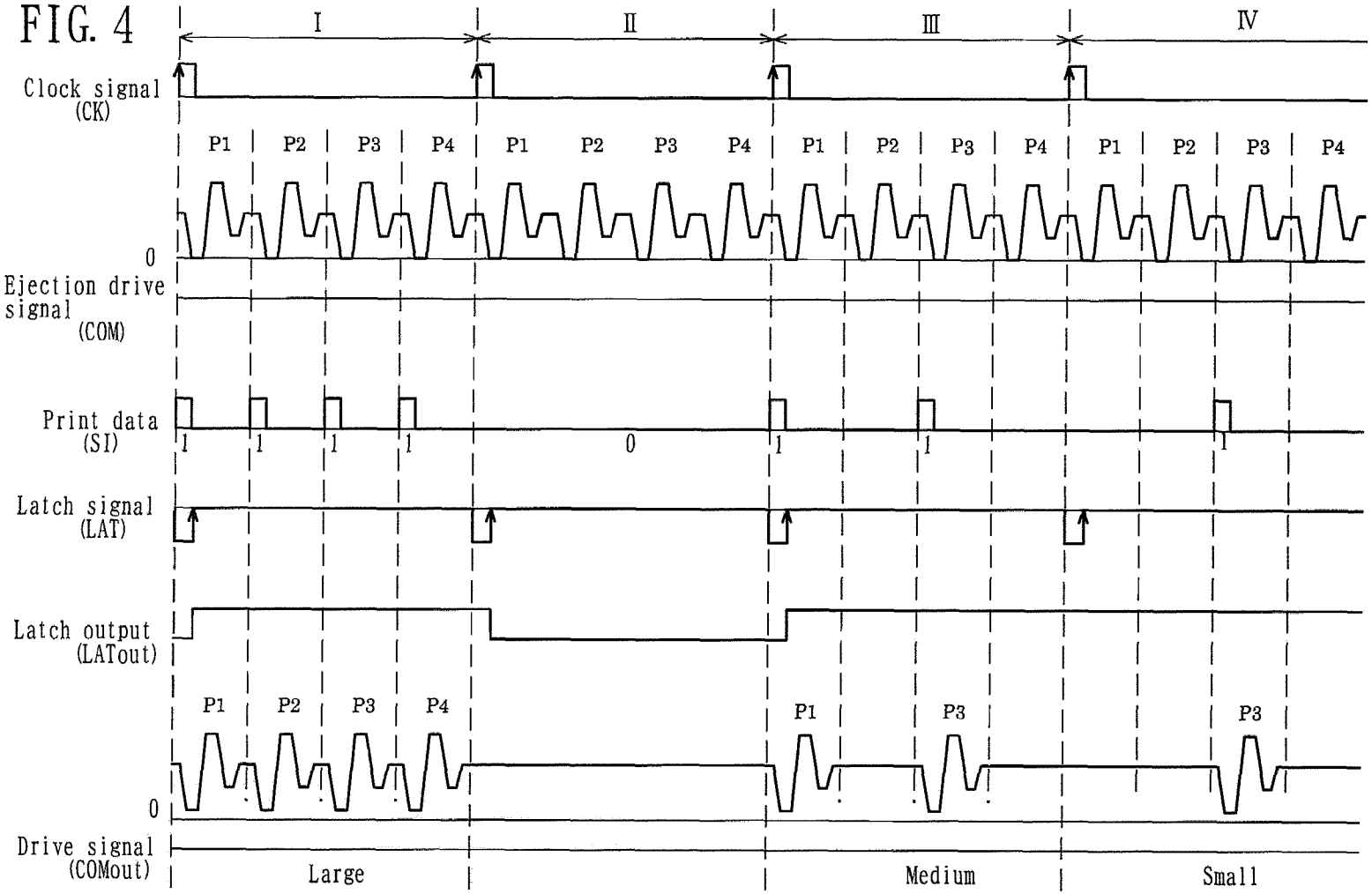
FIG. 4 is an explanation drawing of a procedure for applying drive pulses to a piezoelectric element in the embodiment of the invention.

In the ink-jet recording head 18 having the electrical configuration described above, the print data (SI) constituting the dot pattern data are serially transmitted from the output buffer 23 to the shift register 51 in synchronization with a clock signal (CK) from the oscillation circuit 17, and set therein sequentially, as shown in FIG. 4. In this case, data on the most significant bit among the print data for all the nozzle orifices 36 is serially transmitted. Upon completion of the serial transmission of the most significant bit data, data on the second most significant bit is serially transmitted. Similarly, data on the bits of decreasing significance are serially transmitted.

After the print data on these bits for all the nozzle orifices are set in the shift register elements 51A to 51N, the control section 16 allows a latch signal (LAT) to be outputted to the latch circuit 52 with a predetermined timing. In accordance with this latch signal, the latch circuit 52 latches the print data set in the shift register 51. A latch output (LATout), which is the print data latched by the latch circuit 52, is applied to the level shifter 53 which is a voltage amplifier. The level shifter 53 boosts the print data up to a voltage value, which can drive the switch 54, for example, up to several tens of volts, if the print data is "1", for example. This boosted print data is applied to the switch elements 54A to 54N, whereby the switch elements 54A to 54N are brought into a connected state by the print data.

The ejection drive signal (COM) generated by the drive signal generation circuit 19 is also applied to the switch elements 54A to 54N. When the switch elements 54A to 54N enter the connected state, the ejection drive signal is applied to the piezoelectric elements 41A to 41N connected to the switch elements 54A to 54N.

The ejection drive signal has a plurality of pulse signals in one printing cycle; in the present embodiment, the ejection drive signal has first to fourth pulse signals P1 to P4 which are four identical pulse signals. By selecting one or more signals from among the four pulse signals P1 to P4, a small, medium or large dot is formed according to the number of the pulse signals selected.

With the ink-jet recording head 18 illustrated above, whether to apply the ejection drive signal to the piezoelectric element 41 can be controlled, and what size to form for the dot to be ejected can be selected, according to the print data. In the printing cycle I, for example, print data are formed to become "1" during the periods corresponding to the first to fourth pulse signals P1 to P4 so that the ejection drive signal forming a large dot is applied. During the period during which the print data is "1", the switch 54 is brought into the connected state by the latch signal (LAT). Thus, a drive signal (COMout) comprising the first to fourth pulse signals P1 to P4 can be supplied to the piezoelectric element 41. In response to the supplied drive signal (COMout), the piezoelectric element 41 is displaced (deformed). In the printing cycle II, the print data is "0". During the "0" period, the switch 54 is in a non-connected state, so that the supply of the drive signal to the piezoelectric element 41 is cut off. During this period during which the print data is "0", each piezoelectric element 41 retains the immediately preceding potential. Thus, the immediately preceding displaced state is maintained. In the printing cycle III, print data are formed to become "1" during the periods corresponding to the first and third pulse signals P1 and P3 so that the ejection drive signal forming a medium dot is applied. Thus, the drive signal (COMout) comprising the first and third pulse signals P1 and P3 is supplied to the piezoelectric element 41. In the printing cycle IV, print data are formed to become "1" during the period corresponding only to the third pulse signal P3 so that the ejection drive signal forming a small dot is applied. Thus, the drive signal (COMout) comprising the third pulse signal P3 is supplied to the piezoelectric element 41.

Figure 5:
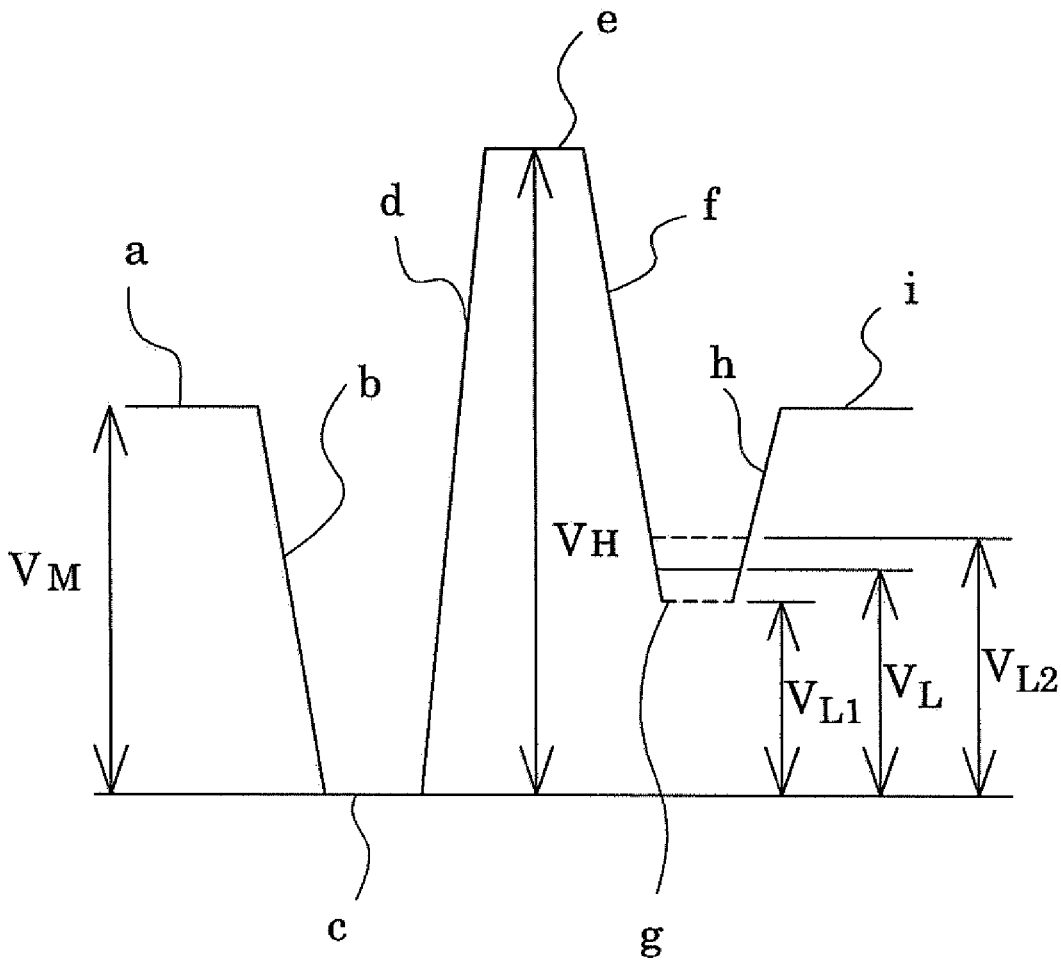
FIG. 5 is a view showing an example of one pulse signal of a drive signal according to the embodiment of the invention.

FIG. 5 shows an example of the waveform of one pulse signal of the drive signal (COMout) in a detailed manner. This pulse signal, before entry into a print state, has a first hold step a in which an electric field is applied, with voltage between the lower electrode film 38 and the upper electrode film 40 being maintained, for example, at a medium voltage $V_M$, which is about 60% of a maximum drive voltage $V_H$, namely, at 15V or so for the drive voltage set at 25V, whereby the pressure generating chamber 32 is held in a state nearly intermediate between the most contracted state and the most expanded state. Then, the pulse signal has a first expansion step b in which meniscus of the nozzle orifice 36 is maximally drawn in toward the pressure generating chamber 32. Then follows a second hold step c in which this state is held in order to provide the right timing of ejecting an ink droplet, and a first contraction step d in which the maximum drive voltage $V_H$, for example, 25V, is applied again to contract the pressure generating chamber 32, thereby ejecting an ink droplet. Immediately after the first contraction step d, a third hold step e comes, followed by a second expansion step f in which the voltage falls to a low voltage $V_L$ which is lower than the medium voltage $V_M$. After the second expansion step f, a fourth hold step g and a second contraction step h are provided, followed by a fifth hold step in which the medium voltage $V_M$ is held. This step i is in preparation for next ejection.

The second expansion step f has a vibration damping waveform for imparting a counter vibration which damps the vibration of ink due to ink ejection in the first contraction step d. The second expansion step f is designed to impart vibration with a timing which is a half of the natural vibration cycle Tc of ink in the pressure generating chamber 32. In further detail, this vibration damping waveform is intended to counter the vibration in the cycle Tc due to ink ejection in the first contraction step d, thereby reducing residual vibration and permitting driving at a high frequency.

The damping property of the second expansion step f having the vibration damping waveform, namely, the magnitude of the vibration damping action, depends on the voltage difference (amplitude) between the maximum drive voltage $V_H$ and the low voltage $V_L$, or the speed of the second expansion step f, namely, the inclination of the waveform. Concretely, the larger the voltage difference, the higher the vibration damping property, and the smaller the voltage difference, the lower the vibration damping property; or the higher the speed, the higher the vibration damping property, and the lower the speed, the lower the vibration damping property.

The above-described waveform of the pulse signal is a general waveform in a so-called pull-and-shoot mode, and a single waveform is designed to eject a liquid droplet weighing, for example, 6 ng. Hence, a large dot formed by selecting four consecutive pulse signals is a liquid droplet weighing about 24 ng, a medium dot formed from two pulse signals is a liquid droplet weighing about 12 ng, and a small dot formed from one pulse signal is a liquid droplet weighing about 6 ng.

The pulse signal of the drive signal is not limited to the above-mentioned one example, and may be, for example, a waveform in a so-called push-and-shoot mode. Nor is the type of the waveform limited, and a rectangular waveform as well as the illustrated trapezoidal waveform may be used.

The number of the pulse signals formed in one printing cycle is not limited to four, but may be two or larger, i.e., plural. Furthermore, the pulse signals formed in one printing cycle need not be in the same waveform as stated above. A plurality of types of pulse signals may be formed in one printing cycle, and liquid droplets of different sizes may be produced by using a combination of different pulse signals.

Besides, the structure of the ink-jet recording head which can realize the drive method of the invention is not limited. For example, the invention can be applied to an ink-jet recording head in which the piezoelectric actuator is formed on a silicon substrate, rather than on the ceramic substrate, by a thin film forming process, and the pressure generating chamber is formed by anisotropic etching. Nor is the structure for ink supply, such as the location of the nozzle orifice or the location of the reservoir, subject to limitation.

In producing the above-described ink-jet recording head and driving it, it is necessary to set a first drive signal, and set a first drive voltage, in accordance with the design of the ink-jet recording head. Depending on the individual difference among the heads due to a manufacturing error, the drive voltage may be changed. That is, the drive voltage and the drive signal may be individually set in the light of actual ejection tests so that ejection can take place, as designed. Based on the results, adjustments may be made such that ejection characteristics become uniform, regardless of individual differences. Concretely, the heads are ranked according to the results of the ejection tests, the drive voltage and the drive waveform are determined by rank, and they are individually chosen for and set in the drive IC installed on the ink-jet recording head.

The method for producing the ink-jet head according to the present embodiment can easily set the drive voltage and the drive waveform such that no variations occur in the ejection of large, medium and small dots. Moreover, this method can easily prevent the occurrence of variations in the sizes of liquid droplets due to variations of the ink-jet head, particularly, the ink supply path 33. That is, when a large dot is formed by a plurality of consecutive pulse signals as mentioned earlier, the resulting liquid droplet may deviate from the design value owing to variations in ink supply associated with the variations of the ink supply path 33. Concretely, if the ink supply path 33 is larger than the size of the design value, ink fill to the nozzle orifice 36 is faster than that according to the design value. As a result, ink tends to exit more easily than in the case of the design value upon ejection at a high frequency. If the ink supply path 33 is smaller than the size of the design value, on the other hand, ink fill to the nozzle orifice 36 is slower than that according to the design value. As a result, ink tends to exit with more difficulty than in the case of the design value upon ejection at a high frequency.

Such a deviation from the design value is generally accommodated by individually setting the drive signal and the drive voltage. In forming liquid droplets of different sizes, i.e., large, medium and small liquid droplets, adapted to different demands, it is difficult to set conditions which enable all the liquid droplets to be formed as designed. However, an explanation will be offered for a procedure which makes it possible to easily set drive conditions ensuring variation-free ejection for all liquid droplets including large, medium and small ones.

In easily setting the conditions which enable large, medium and small liquid droplets to be formed as designed, the vibration damping property of the vibration damping waveform will be adjusted in the following embodiment, and the effect of the adjusted vibration damping property on ejection will be described.

Figure 6A:
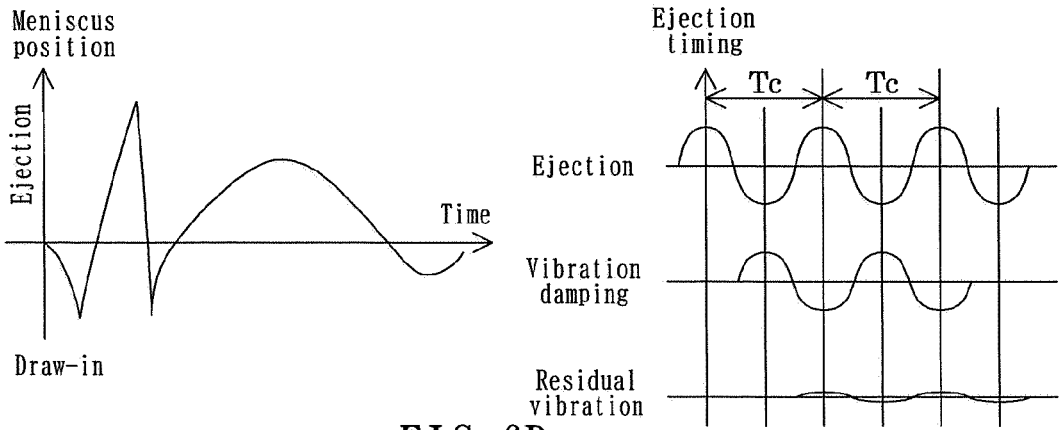
FIGS. 6A to 6C are explanation drawings of a procedure for setting a drive voltage and the drive signal according to the embodiment of the invention.
Figure 6B:
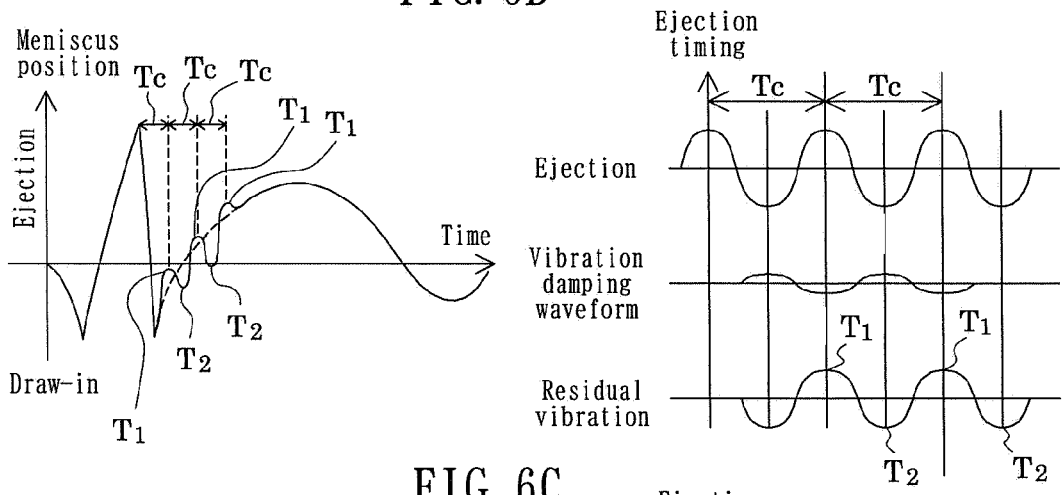
Figure 6C:
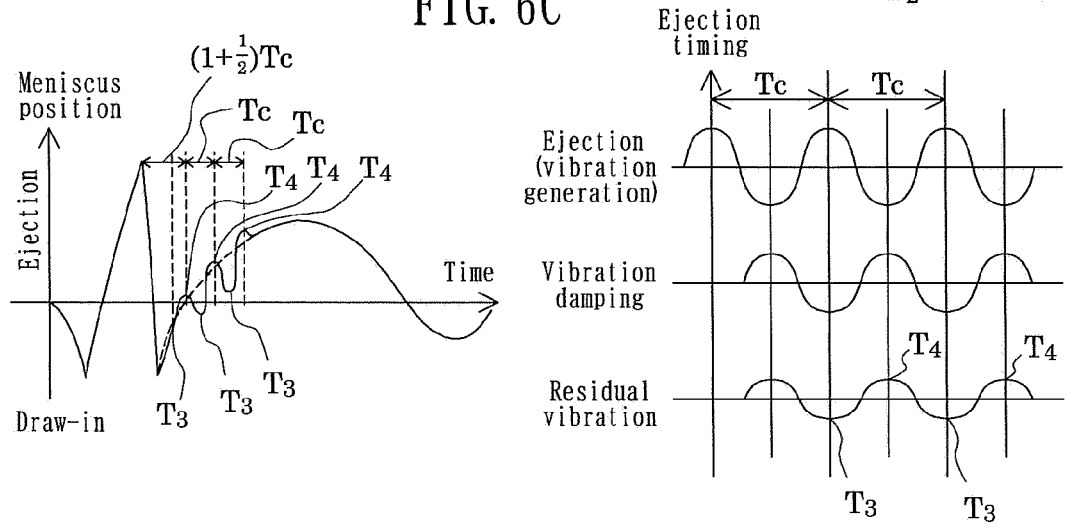

The left-hand portions of FIGS. 6A, 6B and 6C each schematically show the position of meniscus, while the right-hand portions of FIGS. 6A, 6B and 6C each show vibration of ejection by the first contraction step d, vibration by vibration damping in the second expansion step f, and vibration which is a combination of these vibrations. FIG. 6A shows a case in which the vibration of ejection and the vibration by vibration damping are nearly equal and counteract each other. After ejection, the meniscus is drawn in greatly toward the pressure generating chamber 32. Then, the meniscus is shown to protrude without vibration, although small vibration occurs actually. FIG. 6B shows a state in which the vibration damping waveform is rendered small. FIG. 6C shows a state in which the vibration damping waveform is rendered large.

In the case of FIG. 6B, the vibration damping waveform is so small that the residual waveform of the meniscus vibrates in a direction, in which the meniscus protrudes toward the side opposite to the pressure generating chamber 32, at a position Tc apart from the ejection timing. Thus, in the case of the large dot mentioned above, a liquid droplet ejected by the pulse signal tends to grow large, with a timing with which the timing for ejection by the pulse signal P2 after ejection by the first pulse signal P1 is synchronized with the Tc cycle (if the waveform interval between the pulse signal P1 and the pulse signal P2 is an integer n times the natural vibration cycle Tc of the liquid within the pressure generating chamber), namely, with a timing T1. On the other hand, a liquid droplet tends to become small, with a timing with which the timing for ejection by the pulse signal P2 is shifted from the Tc cycle by a half cycle (if the waveform interval between the pulse signal P1 and the pulse signal P2 is (the integer n+½) times the natural vibration cycle Tc of the liquid within the pressure generating chamber), namely, with a timing T2.

In the case of FIG. 6C, the amplitude of the vibration damping waveform is larger than the amplitude of the ejection waveform. Thus, the residual waveform vibrates in a direction, in which the meniscus protrudes, at a position (the integer n+½) times Tc apart from the ejection timing. Thus, in the case of the large dot mentioned above, a liquid droplet ejected by the pulse signal tends to become small, with a timing with which the timing for ejection by the pulse signal P2 after ejection by the first pulse signal P1 is synchronized with the Tc cycle (if the waveform interval between the pulse signal P1 and the pulse signal P2 is the integer n times the natural vibration cycle Tc of the liquid within the pressure generating chamber), namely, with a timing T3. On the other hand, a liquid droplet tends to become large, with a timing with which the timing for ejection by the pulse signal P2 is shifted from the Tc cycle by a half cycle (if the waveform interval between the pulse signal P1 and the pulse signal P2 is (the integer n+½) times the natural vibration cycle Tc of the liquid within the pressure generating chamber), namely, with a timing T4.

Figure 7:
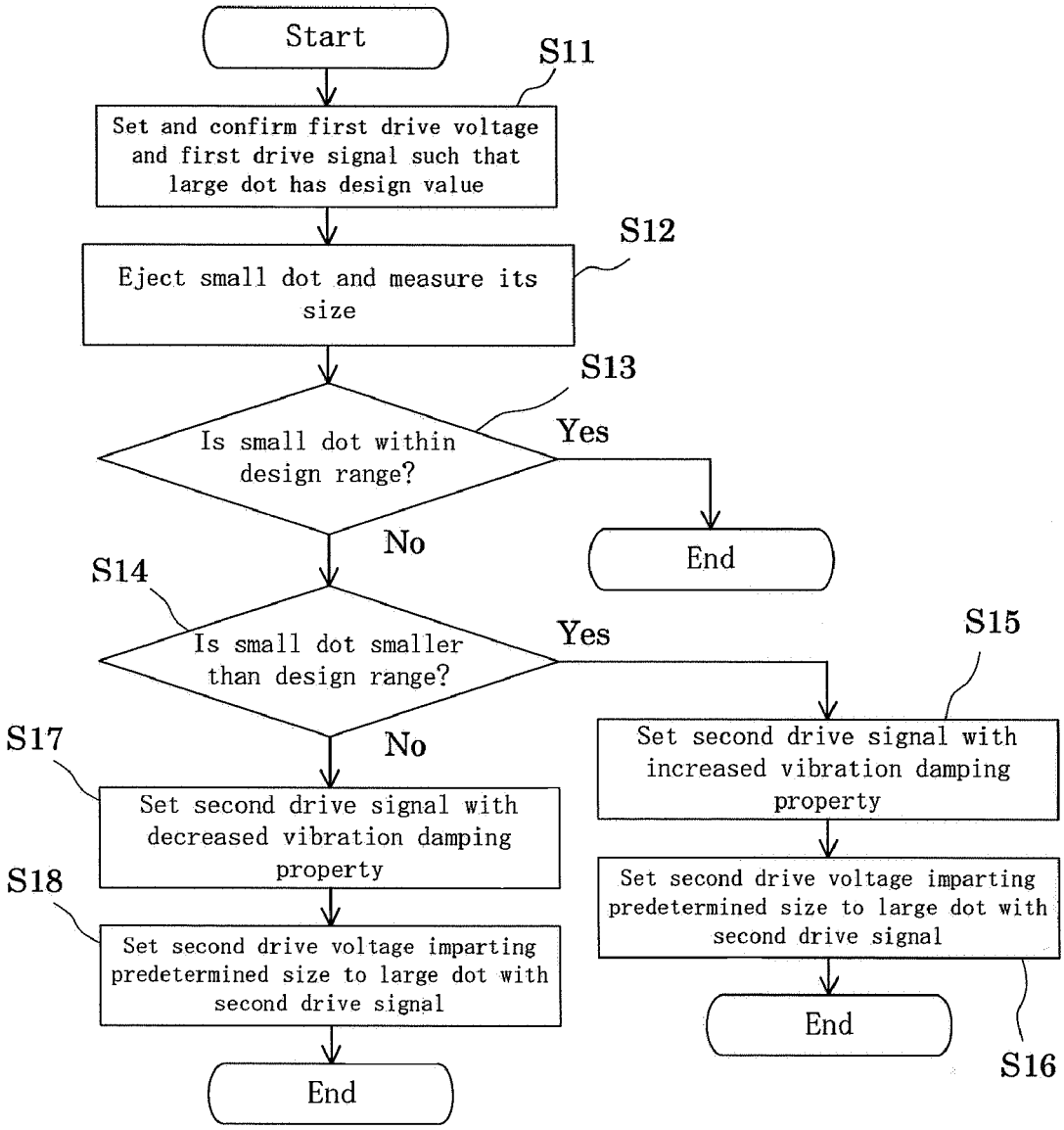
FIG. 7 is a view showing the procedure for setting the drive voltage and the drive signal according to the embodiment of the invention.

The procedure described below is performed based on the above theory, and its explanation will be offered with reference to FIG. 7. FIG. 7 shows the procedure in a case where the waveform interval between the pulse signals is the integer n times the natural vibration cycle Tc of the liquid within the pressure generating chamber.

First of all, a first drive voltage and a first drive signal are set such that a large dot has the design value, and they are confirmed, in accordance with a general procedure (Step S11). Generally, the first drive voltage and the first drive signal are selected from among a plurality of candidates so that the liquid droplet for the large dot in general use has the design value. In the present embodiment, however, the first drive voltage is set at a standard voltage, for example, 25V. In the pulse signal of FIG. 5, only the low voltage $V_L$ presenting the vibration damping waveform is adjusted to make the weight of a large dot 24 ng. Using such an adjusted pulse signal, the first drive signal is set. That is, if a dot is formed using a plurality of continuous pulse signals, the vibration damping property of the pulse signal is adjusted, whereby the size of a liquid droplet can be increased or decreased relatively easily. Thus, an ejection test is conducted to evaluate the actual ejection characteristics of a head and, based on this outcome, a reference pulse signal for the relevant head is set. This procedure for selecting the drive signal so that the liquid droplet for the large dot is of the design value can be performed relatively easily.

Then, a small dot is ejected by the first drive voltage with the use of the first drive signal, and the size of the liquid droplet is measured (Step S12). Then, it is determined whether the small dot is a liquid droplet of the value in the design range (Step S13). If the small dot is within the design range, the program ends, with the setting maintained. If it is outside the design range (No in Step S13), it is determined whether the small dot is smaller than the design value (Step S14). If it is smaller, a second drive signal is set such that a large dot becomes small upon application of the same drive voltage (Step S15). In the present embodiment, the second drive signal is changed to become a drive signal with an increased vibration damping property, by selecting low $V_{L1}$ as the low voltage $V_L$ to widen the voltage difference (amplitude) which is the difference from the maximum voltage $V_H$. To change the vibration damping property, the proportion of adjustment of the voltage difference is conformed to the degree to which the small dot is smaller than the design value. Namely, the smaller the small dot, the higher the proportion of adjustment of the voltage difference is rendered; the larger the small dot, the lower the proportion of adjustment of the voltage difference is rendered. A second drive voltage, which is higher than the drive voltage, is set such that when a large dot is formed using the thus changed second drive signal, the large dot takes on the design value (Step S16). That is, as a result of the change to the second drive signal, the large dot becomes smaller than the design value, unless the drive voltage is changed. However, the second drive voltage is set to be high enough to impart the design value to the large dot.

On the contrary, if the small dot is not smaller than the design value, but larger than it (No in Step S14), a second drive signal is set such that the large dot is made large by the same drive voltage (Step S17). In the present embodiment, the second drive signal is changed to become a drive signal with an decreased vibration damping property, by selecting high $V_{L2}$ as the low voltage $V_L$ to narrow the voltage difference (amplitude) which is the difference from the maximum voltage $V_H$. To change the vibration damping property, the proportion of adjustment of the voltage difference is conformed to the degree to which the small dot is larger than the design value. Namely, the larger the small dot, the higher the proportion of adjustment of the voltage difference is rendered; the smaller the small dot, the lower the proportion of adjustment of the voltage difference is rendered. A second drive voltage, which is lower than the drive voltage, is set such that when a large dot is formed using the thus changed second drive signal, the large dot takes on the design value (Step S18). That is, as a result of the change to the second drive signal, the large dot becomes larger than the design value, unless the drive voltage is changed. However, the second drive voltage is set to be low enough to impart the design value to the large dot.

By setting the second drive signal and the second drive voltage in the above-mentioned manner, the large dot can be set at the design value and, at the same time, the small dot can be set at nearly the design value.

In the descriptions of the invention, the large dot and the small dot are relative expressions, and the large dot and the small dot can be read as the large dot and the medium dot, or as the medium dot and the small dot. In this case as well, the same effect is exhibited.

Next, the procedure in a case where the waveform interval between the pulse signals is (the integer n+½) times the natural vibration cycle Tc of the liquid within the pressure generating chamber will be described with reference to FIG. 8.

Since Steps S21 to S24 are the same as Steps S11 to S14 in FIG. 7, their explanations are omitted. If the small dot is smaller than the value within the design range in Step S24, a second drive signal is set in Step S25 such that the large dot becomes small at the same drive voltage. In this case, the second drive signal with a decreased vibration damping property is set, as contrasted with the case in FIG. 7. Concretely, in the present embodiment, the second drive signal is changed to become a drive signal with a decreased vibration damping property, by raising the low voltage $V_L$ to narrow the voltage difference (amplitude) which is the difference from the maximum voltage $V_H$. As a result of using the thus changed second drive signal, the large dot becomes smaller than the design value, unless the drive voltage is changed. However, the second drive voltage is set to be high enough to impart the design value to the large dot (Step S26).

If the small dot is not smaller than the design range, but larger than it (No in Step S24), on the other hand, a second drive signal is set in Step S27 such that the large dot is made large by the same drive voltage. In this case, contrary to FIG. 7, the second drive signal is changed to become a drive signal with an increased vibration damping property, by lowering the low voltage $V_L$ to widen the voltage difference (amplitude) which is the difference from the maximum voltage $V_H$. A second drive voltage, which is lower than the drive voltage, is set such that when a large dot is formed using the thus changed second drive signal, the large dot takes on the design value (Step S28). That is, as a result of the change to the second drive signal, the large dot becomes larger than the design value, unless the drive voltage is changed. However, the second drive voltage is set to be low enough to impart the design value to the large dot.

By setting the second drive signal and the second drive voltage in the above-described manner, the large dot can be set at the design value and, at the same time, the small dot can be set at nearly the design value.

EXAMPLES

The invention will be described in further detail based on Examples.

Example 1

The present example shows a procedure for producing a liquid-jet head in which the natural vibration cycle of ink within the pressure generating chamber is 6.5 μsec; finally determining a drive signal (the above-mentioned second drive signal) and a drive voltage (the above-mentioned second drive voltage) for an individual head; and finalizing a liquid-jet head to be installed in an actual machine.

In the present example, as stated earlier, a drive signal having four pulse signals in one printing cycle is used, a standard drive voltage is 25V, a liquid droplet weighing 6 ng can normally be ejected by one pulse signal, a large dot weighs 24 ng upon selection of four pulse signals, a medium dot weighs 12 ng upon selection of two pulse signals, and a small dot weighs 6 ng upon selection of one pulse signal.

In the present example, for the sake of simplicity, a pulse signal having the waveform shown in FIG. 5 was used as the pulse signal. The durations of the steps b to h were set at 3.0 μsec, 1.5 μsec, 2 μsec, 4.5 μsec, 2 μsec, 1.5 μsec and 1.5 μsec, and the entire wavelength lasted 26.0 μsec. Thus, the waveform interval was four times (an integer times) Tc. For simplification, moreover, the pulse signals were classified into three types, Rank 0, Rank 1 and Rank 2. $V_M$=0.6 $V_H$ was common to the three types, and $V_L$=0.35 $V_H$ for Rank 0, $V_L$=0.30 $V_H$ for Rank 1, and $V_L$=0.40 $V_H$ for Rank 2.

The procedure shown in FIG. 7 was performed, and the results of measurement of the weight of the liquid droplet in each of the runs are shown in Table 1. In the present example, the design range for the small dot was set to be 5.8 ng to 6.2 ng. If deviation from this range occurred, corrections were made for setting a second drive signal and a second drive voltage.

As shown in Table 1, when Rank 0 was set as a first drive signal and the drive voltage was set at 25V, the large dot weighed 24 ng as designed, but the medium dot weighed 11 ng, and the small dot weighed 5.5 ng, the values smaller than the design values of 12 ng and 6 ng. Accordingly, Rank 1 was chosen as a second drive waveform, and a second drive voltage was set at 26V. As a result, the large dot weighed 24 ng, the medium dot weighed 11.6 ng, and the small dot weighed 5.8 ng, all the values falling within the design ranges. When the second drive signal was driven by the first drive voltage, the large dot measured was found to be 22.8 ng. Thus, it was confirmed that setting the drive signal at Rank 1 decreased the size of the large dot.

TABLE 1

| | Drive signal | Drive voltage | Large dot (ng) | Medium dot (ng) | Small dot (ng) |
|---|---|---|---|---|---|
| Initial measurement | Rank 0 | 25 V | 24.0 (6 × 4) | 11.0 (5.5 × 2) | 5.5 (5.5 × 1) |
| Intermediate state | Rank 1 | 25 V | 22.8 (5.7 × 4) | | |
| Final setting | Rank 1 | 26 V | 24.0 (6 × 4) | 11.6 (5.5 × 2) | 5.8 (5.8 × 1) |

Example 2

As in Example 1, the procedure shown in FIG. 7 was performed, and the results of measurement of the weight of the liquid droplet in each of the runs are shown in Table 2.

As shown in Table 2, when Rank 0 was set as a first drive signal and a drive voltage was set at 25V, the large dot weighed 24 ng as designed, but the medium dot weighed 13 ng, and the small dot weighed 6.5 ng, the values larger than the design values of 12 ng and 6 ng. Accordingly, Rank 2 was chosen as a second drive waveform, and a second drive voltage was set at 24V. As a result, the large dot weighed 24 ng, the medium dot weighed 12.4 ng, and the small dot weighed 6.2 ng, all the values falling within the design ranges. When the second drive signal was driven by the first drive voltage, the large dot measured was found to be 25.2 ng. Thus, it was confirmed that setting the drive signal at Rank 2 increased the size of the large dot.

TABLE 2

| | Drive signal | Drive voltage | Large dot (ng) | Medium dot (ng) | Small dot (ng) |
|---|---|---|---|---|---|
| Initial measurement | Rank 0 | 25 V | 24.0 (6 × 4) | 13.0 (6.5 × 2) | 6.5 (6.5 × 1) |
| Intermediate state | Rank 2 | 25 V | 25.2 (6.3 × 4) | | |
| Final setting | Rank 2 | 24 V | 24.0 (6 × 4) | 12.4 (6.2 × 2) | 6.2 (6.2 × 1) |

Example 3

The present example was carried out in the same manner as Examples 1 and 2, except that the pulse signal having an entire wavelength of 22.75 μsec was used. In the present example, the waveform interval was 3.5 times ((integer+½) times) Tc. Thus, the procedure shown in FIG. 8 was performed, and the results of measurement of the weight of the liquid droplet in each of the runs are shown in Table 3.

As shown in Table 3, when Rank 0 was set as a first drive signal and a drive voltage was set at 25V, the large dot weighed 24 ng as designed, but the medium dot weighed 11 ng, and the small dot weighed 5.5 ng, the values smaller than the design values of 12 ng and 6 ng. Accordingly, Rank 2 was chosen as a second drive waveform, and a second drive voltage was set at 26V. As a result, the large dot weighed 24 ng, the medium dot weighed 11.6 ng, and the small dot weighed 5.8 ng, all the values falling within the design ranges. When the second drive signal was driven by the first drive voltage, the large dot measured was found to be 22.8 ng. Thus, it was confirmed that setting the drive signal at Rank 2 decreased the size of the large dot.

TABLE 3

| | Drive signal | Drive voltage | Large dot (ng) | Medium dot (ng) | Small dot (ng) |
|---|---|---|---|---|---|
| Initial measurement | Rank 0 | 25 V | 24.0 (6 × 4) | 11.0 (5.5 × 2) | 5.5 (5.5 × 1) |
| Intermediate state | Rank 2 | 25 V | 22.8 (5.7 × 4) | | |
| Final setting | Rank 2 | 26 V | 24.0 (6 × 4) | 11.6 (5.5 × 2) | 5.8 (5.8 × 1) |

Example 4

Figure 8:
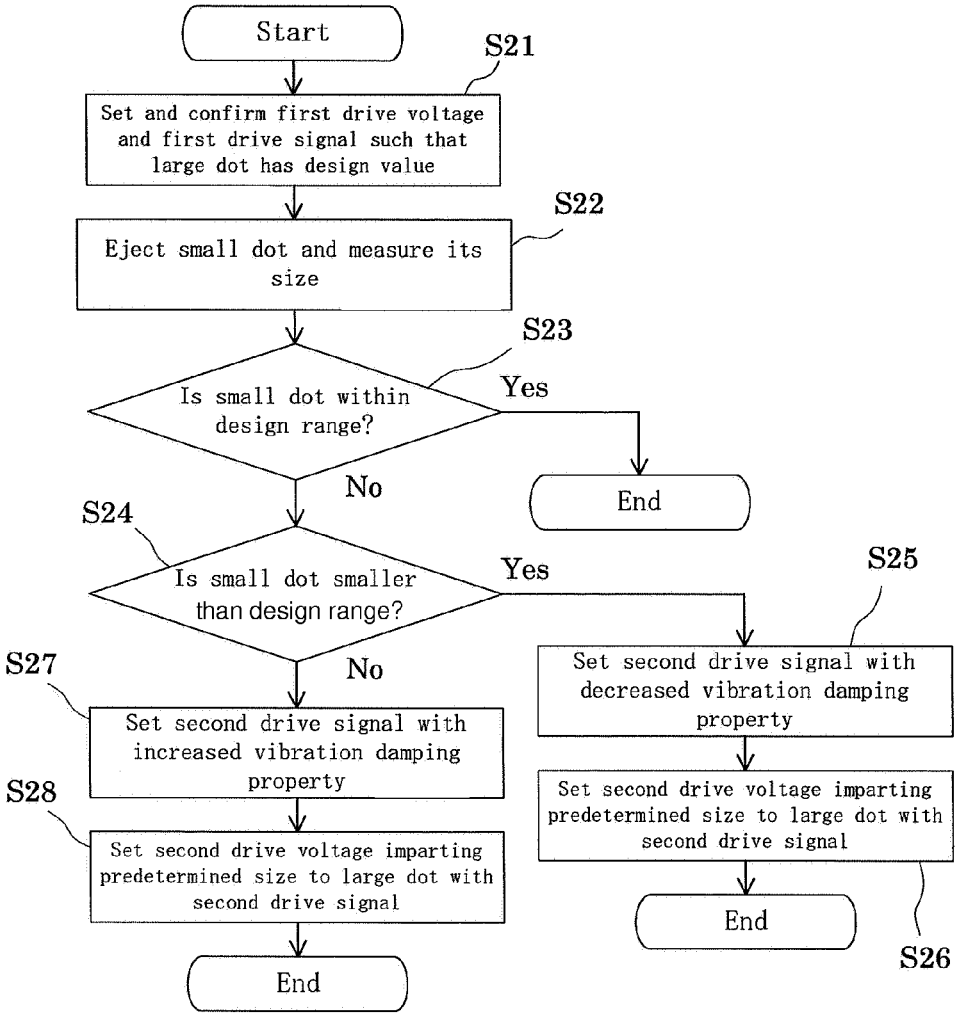
FIG. 8 is a view showing another procedure for setting the drive voltage and the drive signal according to the embodiment of the invention.

As in Example 3, the procedure shown in FIG. 8 was performed, and the results of measurement of the weight of the liquid droplet in each of the runs are shown in Table 4.

As shown in Table 4, when Rank 0 was set as a first drive signal and a drive voltage was set at 25V, the large dot weighed 24 ng as designed, but the medium dot weighed 13 ng, and the small dot weighed 6.5 ng, the values larger than the design values of 12 ng and 6 ng. Accordingly, Rank 1 was chosen as a second drive waveform, and a second drive voltage was set at 24V. As a result, the large dot weighed 24 ng, the medium dot weighed 12.4 ng, and the small dot weighed 6.2 ng, all the values falling within the design ranges. When the second drive signal was driven by the first drive voltage, the large dot measured was found to be 25.2 ng. Thus, it was confirmed that setting the drive signal at Rank 1 increased the size of the large dot.

TABLE 4

| | Drive signal | Drive voltage | Large dot (ng) | Medium dot (ng) | Small dot (ng) |
|---|---|---|---|---|---|
| Initial measurement | Rank 0 | 25 V | 24.0 (6 × 4) | 13.0 (6.5 × 2) | 6.5 (6.5 × 1) |
| Intermediate state | Rank 1 | 25 V | 25.2 (6.3 × 4) | | |
| Final setting | Rank 1 | 24 V | 24.0 (6 × 4) | 12.4 (6.2 × 2) | 6.2 (6.2 × 1) |

In the above examples, the piezoelectric element having the piezoelectric layer formed by the thin film forming process is illustrated as a pressure generating element for explanation. However, the piezoelectric element may be one using a thick-film piezoelectric layer, or may be one using a stacked piezoelectric layer. The invention can be applied to a piezoelectric actuator in any of the longitudinal vibration mode and the flexural vibration mode. In the above embodiments, the ink-jet recording head for ejecting ink is used for illustration. However, this is not limitative, and the invention can be generally applied in producing wide varieties of liquid-jet heads. Examples of the liquid-jet heads are recording heads for use in image recording devices such as printers, color material jet heads for use in the production of color filters for liquid crystal displays, electrode material jet heads for use in the formation of electrodes for organic EL displays and FED (face emitting displays), and bio-organic material jet heads for use in the production of biochips. It should be understood that such changes, substitutions and alterations can be made in the invention without departing from the spirit and scope of the invention as defined by the appended claims.

What is claimed is:

1. A method for producing a liquid-jet head, the liquid-jet head including a drive IC and a pressure generating element for ejecting a liquid within a pressure generating chamber through a nozzle orifice, the liquid-jet head selectively forms a large dot upon selection of a plurality of pulse signals from plural pulse signals generated within one recording cycle, and selectively forms a small dot upon selection of a smaller number of the pulse signals than the number of the plurality of the pulse signals for the large dot, the pulse signal having an ejection step of contracting the pressure generating chamber to eject a liquid droplet through the nozzle orifice, and a vibration damping step of expanding the pressure generating chamber with a predetermined timing after the ejection step to damp vibration of the liquid within the pressure generating chamber after ejection, the method comprising:

a measurement step of setting on the drive IC a first drive waveform, as the pulse signal, and a first drive voltage such that the large dot of a desired size can be formed, and measuring a size of the small dot with use of the first drive waveform and the first drive voltage; and a correction step of setting on the drive IC a second drive waveform whose waveform corresponding to the vibration damping step has been adjusted in a direction in which the large dot becomes small, and also setting on the drive IC a second drive voltage which is higher than the first drive voltage, when the measured size of the small dot is smaller than a predetermined size, and setting on the drive IC a second drive waveform whose waveform corresponding to the vibration damping step has been adjusted in a direction in which the large dot becomes large, and also setting on the drive IC a second drive voltage which is lower than the first drive voltage, when the measured size of the small dot is larger than the predetermined size.

2. The method for producing a liquid-jet head according to claim 1, wherein adjustment of a vibration damping property of the waveform corresponding to the vibration damping step is adjustment of an amplitude of the waveform corresponding to the vibration damping step.

3. The method for producing a liquid-jet head according to claim 2, wherein the second drive waveform whose waveform corresponding to the vibration damping step has been adjusted in the direction in which the large dot becomes small has been increased in the amplitude of the waveform corresponding to the vibration damping step when a waveform interval of the second drive waveform is an integer n times a natural vibration cycle Tc of the liquid within the pressure generating chamber, the second drive waveform whose waveform corresponding to the vibration damping step has been adjusted in the direction in which the large dot becomes small has been decreased in the amplitude of the waveform corresponding to the vibration damping step when the waveform interval of the second drive waveform is (the integer n+½) times the natural vibration cycle Tc of the liquid within the pressure generating chamber, the second drive waveform whose waveform corresponding to the vibration damping step has been adjusted in the direction in which the large dot becomes large has been decreased in the amplitude of the waveform corresponding to the vibration damping step when the waveform interval of the second drive waveform is the integer n times the natural vibration cycle Tc of the liquid within the pressure generating chamber, and the second drive waveform whose waveform corresponding to the vibration damping step has been adjusted in the direction in which the large dot becomes large has been increased in the amplitude of the waveform corresponding to the vibration damping step when the waveform interval of the second drive waveform is (the integer n+½) times the natural vibration cycle Tc of the liquid within the pressure generating chamber.

4. The method for producing a liquid-jet head according to claim 1, wherein an interval between the ejection step and the vibration damping step is a half of a natural vibration cycle Tc of the liquid within the pressure generating chamber.

5. The method for producing a liquid-jet head according to claim 1, wherein the second drive waveform and the second drive voltage are selected from drive waveforms and drive voltages which have been prepared beforehand.

6. A method for driving a liquid-jet head including a pressure generating element for ejecting a liquid within a pressure generating chamber through a nozzle orifice, the method being adapted to selectively form a large dot upon selection of a plurality of pulse signals from plural pulse signals generated within one recording cycle, and to selectively form a small dot upon selection of a smaller number of the pulse signals than the number of the plurality of the pulse signals for the large dot, the pulse signal having an ejection step of contracting the pressure generating chamber to eject a liquid droplet through the nozzle orifice, and a vibration damping step of expanding the pressure generating chamber with a predetermined timing after the ejection step to damp vibration of the liquid within the pressure generating chamber after ejection, the method comprising:

setting a first drive waveform, as the pulse signal, and a first drive voltage, such that the large dot of a desired size can be formed;

measuring a size of the small dot with use of the first drive waveform and the first drive voltage;

setting a second drive waveform whose waveform corresponding to the vibration damping step has been adjusted in a direction in which the large dot becomes small, and also using a second drive voltage which is higher than the first drive voltage, when the measured size of the small dot is smaller than a predetermined size;

setting a second drive waveform whose waveform corresponding to the vibration damping step has been adjusted in a direction in which the large dot becomes large, and also using a second drive voltage which is lower than the first drive voltage, when the measured size of the small dot is larger than the predetermined size, and driving the liquid-jet head with use of the second drive waveform and the second drive voltage.

* * * * *